US005458267A

United States Patent [19]

Curtis et al.

[11] Patent Number: 5,458,267

[45] Date of Patent: Oct. 17, 1995

[54] SIZEABLE ATTACHMENT DEVICE

[75] Inventors: James H. Curtis, Coral Springs; J. Douglas Boger, North Lauderdale, both of Fla.

[73] Assignee: Motorola, Inc., Schaumburg, Ill.

[21] Appl. No.: 300,764

[22] Filed: Sep. 6, 1994

[51] Int. Cl.[6] ..... A45F 5/00

[52] U.S. Cl. ..... 224/253; 224/901; 2/338; 24/324; 24/304

[58] Field of Search ..... 224/250, 253, 224/255, 910, 901, 150, 257, 258, 42.39, 269, 191; 24/3 L, 182, 304, 481, 697.1, 578, 270, 271, 324; 2/170, 336, 338; D3/215, 218, 219, 229

[56] References Cited

U.S. PATENT DOCUMENTS

| | | | |
|---|---|---|---|
| D. 293,857 | 1/1988 | Stout et al. | D3/229 |
| D. 297,683 | 9/1988 | Beauchan | D3/218 |
| D. 306,299 | 2/1990 | Soren et al. . | |
| D. 329,749 | 9/1992 | Scheid . | |
| D. 347,522 | 6/1994 | Beltran | D3/229 |
| 2,349,264 | 5/1944 | Grice | 24/324 |
| 2,504,369 | 4/1950 | Adair | 224/253 |
| 2,754,532 | 7/1956 | Kanehl et al. | 224/255 |
| 3,160,158 | 12/1964 | Rayhart | 224/250 |
| 3,743,147 | 7/1973 | Wilczynski | 224/199 |
| 3,970,228 | 7/1976 | Keller | 224/253 |
| 4,957,232 | 9/1990 | Sprague | 224/253 |
| 4,963,410 | 10/1990 | Bryant | 24/182 |
| 4,982,885 | 1/1991 | Severson et al. | 224/253 |
| 5,201,447 | 4/1993 | Bumb et al. | 224/243 |

FOREIGN PATENT DOCUMENTS

| | | | |
|---|---|---|---|
| 160228 | 3/1921 | United Kingdom | 24/578 |

OTHER PUBLICATIONS

Motorola, Portable Radio Accessories Manual, RO–9–133, printed in the U.S.A., pp. 1–51.

*Primary Examiner*—Henry J. Recla
*Assistant Examiner*—Gregory M. Vidovich
*Attorney, Agent, or Firm*—Pedro P. Hernandez; Barbara R. Doutre

[57] ABSTRACT

A sizeable attachment device includes a flexible member (102) and a set of first (108) and second (106) sockets which receive a set of back-to back studs formed from back-to-back pairs (110, 112). In a first attachment mode stud 110 is snap fitted to socket 108. In a second attachment mode stud 110 is snap fitted to socket 106, and stud 112 is snap fitted to socket 108. The sizeable attachment device forms two sizes of loops for receiving belts or holsters having different widths. The sizeable attachment device provides for a clean and good looking attachment when either in the first or second attachment modes.

10 Claims, 2 Drawing Sheets

SIZEABLE ATTACHMENT DEVICE

TECHNICAL FIELD

This invention relates in general to mechanical attachment devices, specifically to a sizeable attachment device and in particular to a sizeable attachment device for receiving different sizes of belts.

BACKGROUND

When radio users such as police officers, fireman, etc. carry portable radios, they will typically carry the radio in a radio carry case or they will have a special connector directly on the radio for connecting the radio to their belt. A belt loop is usually employed in order to loop around the radio users belt or holster. The belt loop will then have a special connector for attaching either to the radio carry case or for directly receiving the radio connector. The problem presented by the above approach is that different sizes of belt loops must be used for different width of belts. The most common sizes of belt loops fit belts having widths of 6.35 and 7.62 centimeters (2.5 and 3.0 inches). This presents a problem for the manufacturer who must provide different versions of belt loops having different sizes in order to fit the different size belt widths used by customers, thereby increasing the cost to the manufacture. A need thus exists in the art for a sizeable belt loop which can fit different size belts.

DETAILED DESCRIPTION OF THE PREFERRED EMBODIMENT

Figure 1:
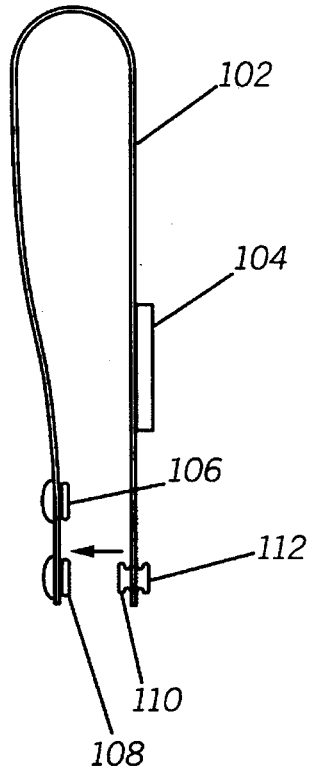
FIG. 1 shows a belt attachment device attaching a first way to fit one size of belt in accordance with the invention.

While the specification concludes with claims defining the features of the invention that are regarded as novel, it is believed that the invention will be better understood from a consideration of the following description in conjunction with the drawing figures. Referring to FIG. 1, a sizeable belt attachment or belt loop in accordance with the invention is shown. The belt attachment includes a flexible member 102 preferably formed from a piece of leather, although other materials such as vinyl, plastic, urethane, etc. can be used as well. The flexible member has two major surfaces, an outer or first surface and an inner or second surface. On the outer surface of the flexible member 102 a receptacle 104 is provided for receiving a connector from a radio carrying case or a connector attached to a radio or other electronic device. First 108 and second 106 sockets are located on one end of the flexible member 102, with the sockets located on the inner surface of the flexible member 102. A set of back-to-back studs 110, 112 are located on the other end of the flexible member 102, one stud located on the inner surface and one located on the outer surface of flexible member 102. In the preferred embodiment, studs 110, 112 are attached to flexible member 102 using a single rivet once the two studs have been properly aligned with each other in a back-to-back relationship.

As shown in FIG. 1, socket 108 is snap fitted to inner surface stud 110 in order to provide for a belt attachment which can receive one size of belt, in this particular case a 7.62 centimeter (3 inch) wide belt. When in this first attachment mode, both ends of flexible member 102 are substantially butted together and both ends are substantially even with respect to each other, thereby providing a clean look to the belt attachment.

Figure 2:
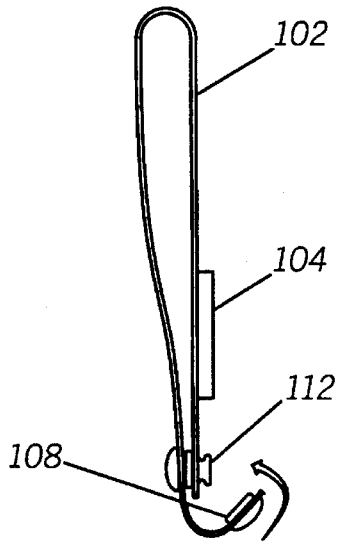
FIG. 2 shows the belt attachment of FIG. I attaching in a second way to fit a second size of belt in accordance with the invention.

In FIG. 2, the same belt attachment shown in FIG. 1 is used to attach to a second size belt. In this second attachment mode, stud 110 is snap fitted with socket 106 to provide for a smaller loop and then socket 108 is looped over the outer surface and snap fitted with stud 112 to form a smaller belt attachment loop. In this particular case, the loop formed by the belt attachment device fits a 6.35 (2.5 inch) centimeter wide belt. In this second mode, the belt attachment device also provides for a clean or good looking fit when worn by the user.

Figure 4:
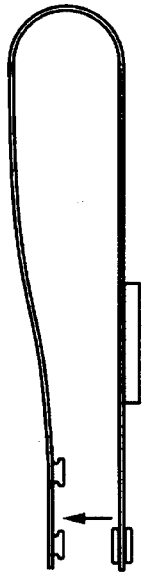
FIG. 4 shows another embodiment of the belt attachment device.

Although the preferred embodiment has shown a pair of studs 110 attaching to a pair of sockets 108 in order to form one of the loops and all the studs 110, 112 and all the sockets 106, 108 to form the other loop, a single socket and one set of back-to-back studs can be used in some applications. For example, where the belt loop is not very wide. Also, the studs and sockets can be interchanged, for example, instead of using back-to-back studs, back-to-back sockets could also be used. This configuration of the belt attachment is shown in FIG. 4 of the accompanying drawings. Furthermore, other types of attachment techniques instead of snap-fit socket/stud combinations can also be employed.

Figure 3:
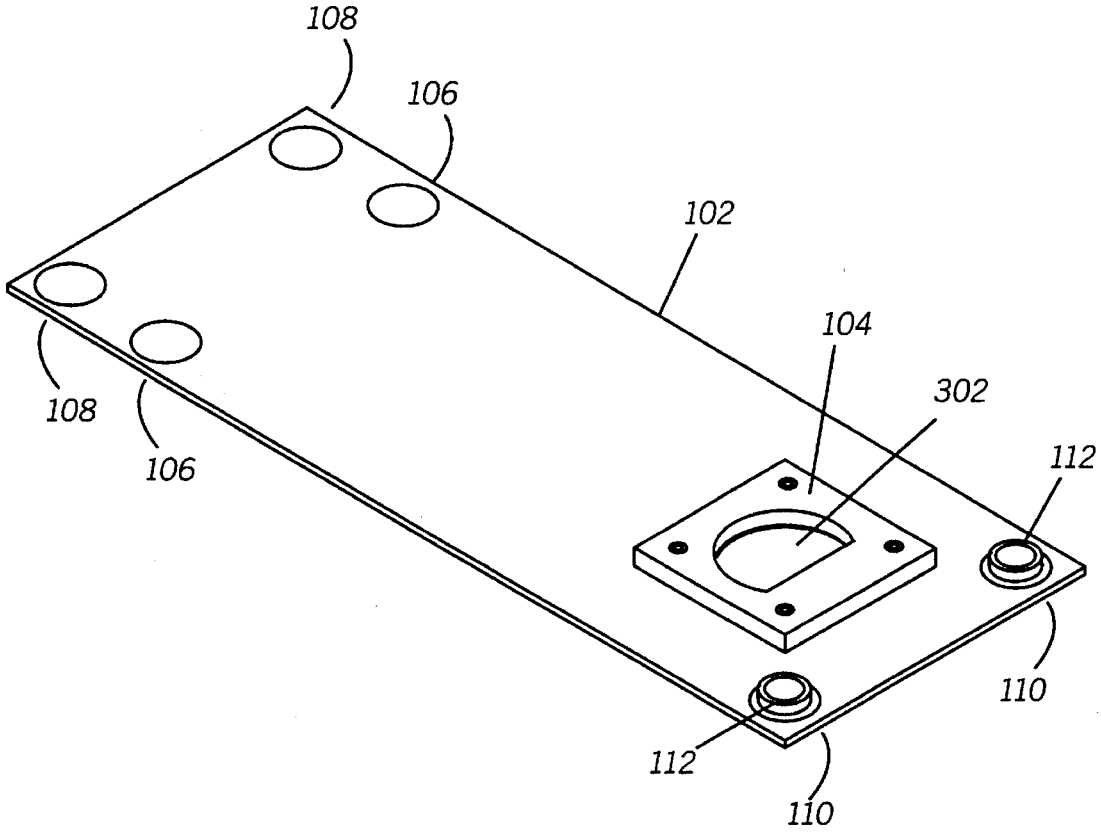
FIG. 3 shows an isometric view of the belt loop in accordance with the invention.

Referring now to FIG. 3, an isometric view of the belt attachment device in accordance with the invention is shown. Receptacle 104 in the preferred embodiment includes a "D" shape slot 302 for receiving either a radio carry case having a male "D" shaped connector or a radio having such a connector attached to the radio. In order to attach the male connector to receptacle 104, the radio or carry case must be tilted approximately 90 degrees in order to fit into receptacle 104 when the belt attachment device is attached to the users belt or holster. This allows for quick connection and disconnection, while preventing the radio or carry case from becoming disconnected while the user is running or carrying out his day to day activities. The radio or carry case is swivable since the "D" shaped slot 302 includes a channel in which the "D" shaped connector from the carry case or radio moves along within.

Sockets 106 and 108 and receptacle are attached to flexible member 102 using well known riveting techniques. The rivets used to attach sockets 106 and 108 preferably include big ends on the first surface in order to prevent the sockets from breaking through the leather.

In summary, the belt attachment device of the present invention provides for an inexpensive way of having one belt attachment device fit more than one belt or holster size and yet look aesthetically pleasing in either first or second attachment modes. Although the preferred embodiment has shown the connections for the flexible member as studs 110, 112 and sockets 106, 108, other removable fastening means using fasteners and fastener receptor can be utilized with the present invention, such as hook and loop, etc.

What is claimed is:

1. An attachment device for a belt, comprising:

a flexible member having first and second surfaces and first and second ends;

first and second sockets each spaced differently from the first end, the first and second sockets attached to and extending from the second surface;

first and second studs attached in a back-to-back and substantially co-located orientation at the second end of the flexible member, the first stud attached to and extending from the first surface and the second stud attached to and extending from the second surface; and said attachment device providing first and second attachment modes which provides at least one loop for attachment to said belt wherein in the first attachment mode the first socket couples to the second stud to provide a first loop for attachment and in the second attachment mode the first socket couples to the first stud and the second socket couples to the second stud to provide first and second loops for attachment.

2. An attachment device as defined in claim 1, wherein the flexible member is formed from leather.

3. An attachment device as defined in claim 1, further comprising a receptacle attached to the first surface for receiving a connector.

4. An attachment device as defined in claim 1 wherein the first loop in the first attachment mode and the first loop in the second attachment mode are different sizes.

5. An attachment device as defined in claim 4 wherein the first loop in the first attachment mode is larger than the first loop in the second attachment mode.

6. An attachment device as defined in claim 4, wherein when the first socket is coupled to the second stud the first and second ends of the flexible member are substantially butted with each other.

7. An attachment device for a belt, comprising:

a flexible member having first and second surfaces and first and second ends;

first and second studs each spaced differently from the first end, the first and second studs attached to and extending from the second surface;

first and second sockets attached in a back-to-back co-located orientation at the second end of the flexible member, the first socket attached to and extending from the first surface and the second socket attached to and extending from the second surface; and said attachment device providing first and second attachment modes which provides at least one loop for attachment to said belt wherein in the first attachment mode the first stud couples to the second socket to provide a first loop for attachment and in the second attachment mode the first stud couples to the first socket and the second stud couples to the second socket to provide first and second loops for attachment.

8. An attachment device as defined in claim 7, wherein the flexible member is formed from leather.

9. An attachment device as defined in claim 7 wherein the first loop in the first attachment mode and the first loop in the second attachment mode are different sizes.

10. An attachment device as defined in claim 9 wherein the first loop in the first attachment mode is larger than the first loop in the second attachment mode.

* * * * *